US011577370B2

(12) United States Patent
Chen

(10) Patent No.: US 11,577,370 B2
(45) Date of Patent: Feb. 14, 2023

(54) UNSYMMETRICAL STRUCTURE FOR AN OPEN-ENDED WRENCH

(71) Applicant: INFAR INDUSTRIAL CO., LTD., Chang-Hwa (TW)

(72) Inventor: Tai-Hung Chen, Chang-Hwa (TW)

(73) Assignee: INFAR INDUSTRIAL CO., LTD., Chang-Hwa (TW)

( * ) Notice: Subject to any disclaimer, the term of this patent is extended or adjusted under 35 U.S.C. 154(b) by 254 days.

(21) Appl. No.: 17/147,456

(22) Filed: Jan. 13, 2021

(65) Prior Publication Data

US 2021/0220971 A1 Jul. 22, 2021

(30) Foreign Application Priority Data

Jan. 17, 2020 (TW) ..... 109101691

(51) Int. Cl.
*B25B 13/08* (2006.01)

(52) U.S. Cl.
CPC ..... *B25B 13/08* (2013.01)

(58) Field of Classification Search
CPC ..... B25B 13/06; B25B 13/065; B25B 13/08
See application file for complete search history.

(56) References Cited

U.S. PATENT DOCUMENTS

| | | | | |
|---|---|---|---|---|
| 5,551,322 | A * | 9/1996 | Mikic | B25B 13/46 81/170 |
| 6,082,228 | A * | 7/2000 | Macor | B25B 13/08 81/186 |
| 7,788,994 | B2 * | 9/2010 | Wright | B25B 13/08 81/186 |
| 8,359,952 | B2 * | 1/2013 | Hsieh | B25B 27/18 81/186 |
| 8,667,873 | B2 * | 3/2014 | Hsieh | B25B 27/18 81/186 |
| 9,522,458 | B2 * | 12/2016 | Chen | B25B 13/08 |
| 10,786,890 | B2 * | 9/2020 | Kukucka | B25B 13/08 |
| 10,953,520 | B2 * | 3/2021 | Macor | B25B 13/08 |

* cited by examiner

*Primary Examiner* — David B. Thomas
(74) *Attorney, Agent, or Firm* — Bruce Stone LLP; Joseph A. Bruce

(57) ABSTRACT

An asymmetrical structure for an open-end wrench is disclosed. The force-applying surface of the wrench facing the opening is mainly set as an arc surface, and the force-receiving surface of the wrench facing the opening is set as a flat surface. When a nut is engaged in the opening of the wrench, one side of the nut abuts against the force-receiving surface, and the other side is in contact with the force-applying point on the arc surface of the force-applying surface. When the wrench is turned, the force of the torque can only be transmitted through the force point contacting the nut, thereby preventing the force of the torque from being dispersed.

11 Claims, 8 Drawing Sheets

UNSYMMETRICAL STRUCTURE FOR AN OPEN-ENDED WRENCH

BACKGROUND

Field of the Invention

The present invention relates to an open-ended wrench, and more particularly to an unsymmetrical structure for an open-ended wrench.

Related Prior Art

Please refer to FIG. 1, which shows the most common metric open-end wrench in the current technical field of wrenches, one end of this open-end wrench has a working head, and the working head is provided with an opening for engaging with a nut and to allow the user to pull the handle. The opening fixes the nut, and the length of the grip is a force arm. When the user pulls the handle and applies a force to it, the opening of the wrench affects the nut. Torque is the product of force and lever arm also known as moment arm (T=Fr).

FIG. 1 is a magnified side view showing a part of a general open-end wrench where the opening 10 is located. The opening 10 essentially includes a force-applying surface 11 and a force-receiving surface 12 opposite and parallel to each other, and two fixing surfaces 13 connected to the force-applying surface 11 and the force-receiving surface 12, so that the inner surface of the opening 10 sequentially includes one force-applying surface 11, two fixing surfaces 13, and one force-receiving surface 12. An inner angle 14 of 60 degrees is sandwiched between each two neighboring surfaces, so that the opening 10 co-defined by the force-applying surface 11, the fixing surfaces 13, and the force-receiving surface 12 can be engaged with a hexagon nut. When the hexagon nut is engaged in the opening and the wrench rotates, the force-applying surface 11 mainly applies the force of the torque to one surface of the nut, and the force-receiving surface 12 is provided for the nut to abut against. It is worth noting that each time the hexagonal nut is fixed in the opening 10, the sharp angle of the hexagonal nut corresponds to and tightly engages with each corresponding inner angle 14. Every time the nut is turned, the fragile sharp angles of the nut are attached too close to the inner angles 14 of the opening 10. When the force-applying surface 11, the fixing surfaces 13, and the force-receiving surface 12 transfers force to the sharp angles of the nut, it is easy to cause cracks at sharp angles.

Therefore, in order to overcome the aforementioned problem of easy cracking of sharp angles, an open-end wrench that prevents cracking was invented. Please refer to FIG. 2, which is a magnified view of a part of the cracking-proof open-end wrench, this type of open-end wrench is provided with an anti-cracking inner groove 24 at each of the connections between the force-applying surface 21, the fixing surface 22, and the force-receiving surface 23, so that when the nut is engaged in the open-end wrench, the sharp angles of the nut are respectively located at the positions corresponding to the anti-cracking inner grooves 24. When the open-end wrench that prevents cracking is rotated, the force-applying surface 21, the fixing surface 22, and the force-receiving surface 23 will not directly abut against the nut, nor will they directly apply force to the sharp angles of the nut, so as to prevent occurrence of cracking at the sharp angles of the nut.

The aforementioned two wrenches are actually the two most common types in the technical field of open-end wrenches. However, the force-applying surface 21 and the force-receiving surface 23 of the aforementioned two open-ended wrenches are parallel to each other. When the nut is engaged in the opening, the two parallel surfaces of the nut will be completely abutted against the force-applying surface 21 and the force-receiving surface 23, and each time the wrench is rotated, the torque is mainly transmitted from the force-applying surface 21 to the nut. Since the force-applying surface 21 contacts the nut in a large area, the torque of the wrench is perpendicular to the force-applying surface 21 and transmitted to the nut, resulting in the force being dispersed in a large area in each position where the force-applying surface 21 contacts the nut.

In view of this, it is indeed necessary to provide a new technical solution to solve the aforementioned problems.

SUMMARY

One objective of the present invention is to solve the problem that the force will be dispersed by the force-applying surface of the open-end wrench.

To achieve the above objective, an unsymmetrical structure for an open-ended wrench provided by the invention comprises:

a handle;

a working head disposed on the handle, wherein the working head is provided with an opening, and a force-receiving surface, a force-applying surface, four round-angle surfaces and two fixing surfaces, which face the opening, the force-receiving surface is a flat surface facing the opening, the opening is used for engaging with a nut, a torque center of the nut defines an axial center in the opening, the axial center extends toward the force-receiving surface to define a horizontal axis perpendicular to the force-receiving surface, the force-applying surface protrudes toward the axial center, the axial center extends along the horizontal axis to the force-applying surface to define a force-applying point, the two round-angle surfaces are respectively connected to two ends of the force-applying surface, a tangent point is defined at each of the positions where the two round-angle surfaces are connected to the force-applying surface, and a force-applying distance is defined between the force-applying point and each of the tangent points along the horizontal axis.

In a preferred embodiment, the force-applying surface is an arc of a first imaginary circle with a diameter of 25.3 cm, and each of the round-angle surfaces is an arc of a second imaginary circle of 1.87 cm.

In a preferred embodiment, each of the tangent points defined at the positions where the force-applying surface and the two round-angle surfaces are connected is located at the position where the first imaginary circle and the two second imaginary circles are tangent to each other, the two tangent points extend along the horizontal axis to define two tangent lines, the centers of the two second imaginary circles extend along the horizontal axis to define two axes, the tangent lines are parallel to the axes, and the tangent lines are located between the two axes.

In a preferred embodiment, the working head further includes a clamping surface facing the opening, the clamping surface is connected to one of the round-angle surfaces, so that this one of round-angle surfaces is located between the clamping surface and the force-applying surface, the axial center defines a longitudinal axis perpendicular to the horizontal axis, and an intersection point where the longitudinal axis and the horizontal axis insect is the axial center, there is a first distance between the clamping surface and the longitudinal axis along the horizontal axis, a distance from the tangent point of the round-angle surface located between the clamping surface and the force-applying surface to the longitudinal axis along the horizontal axis is a second distance, and the first distance is smaller than the second distance.

In a preferred embodiment, the force-applying surface is provided with a plurality of teeth, and the force-applying point is located at a position wherein the force-applying surface intersects the horizontal axis.

In a preferred embodiment, the force-applying surface is provided with a plurality of teeth, tips of the teeth sequentially form an arc surface of the force-applying surface, and the force-applying point is located at a position wherein the force-applying surface intersects the horizontal axis.

In a preferred embodiment, a distance extending from the axial center along the horizontal axis to the force-receiving surface is equal to a distance extending from the axial center along the horizontal axis to the force-applying point, the two tangent points are connected to the axial center by two radial lines, a radial angle is sandwiched between the two radial lines, and the radial angle is 10 to 60 degrees.

In a preferred embodiment, the radial angle is between 20 degrees and 45 degrees.

In the present invention, by setting the force-applying surface of the wrench as an arc surface, the force-applying surface and the nut are contacted only by the force-applying point, so that the force of the torque can be transmitted to the nut only through the force-applying point, therefore the force is not dispersed and the user can turn the nut more easily.

More preferably, since the first distance is smaller than the second distance, when the wrench is rotated and the nut slightly deflects in the opening, the sharp angle of the nut can be located correspondingly in one of the round-angle surfaces, so that the round-angle surface can prevent the nut from coining out of the opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
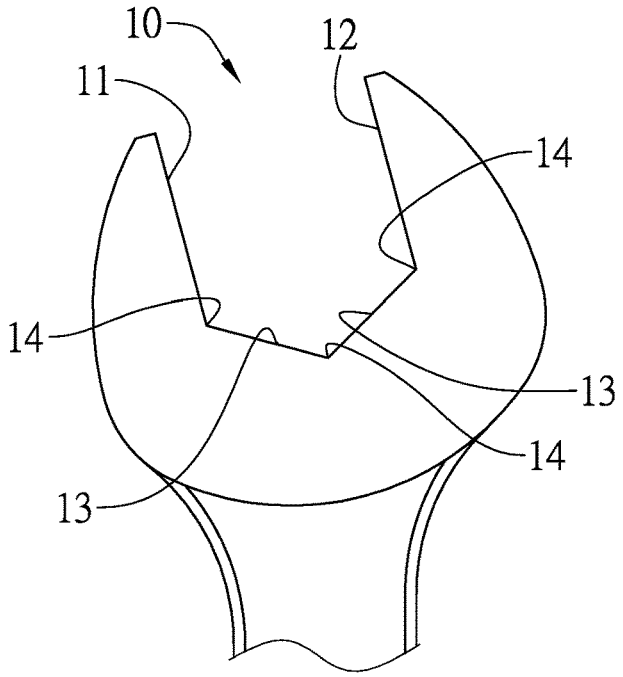
FIG.1 PRIOR ART
FIG. 1 is a magnified side view of a part of a conventional open-end wrench.
Figure 2:
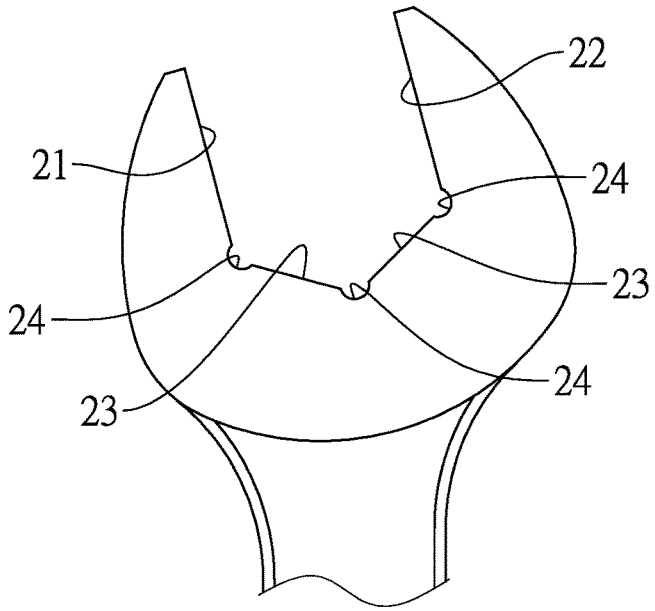
FIG.2 PRIOR ART
FIG. 2 is a magnified side view of a part of a conventional cracking-proof open-end wrench.
Figure 3:
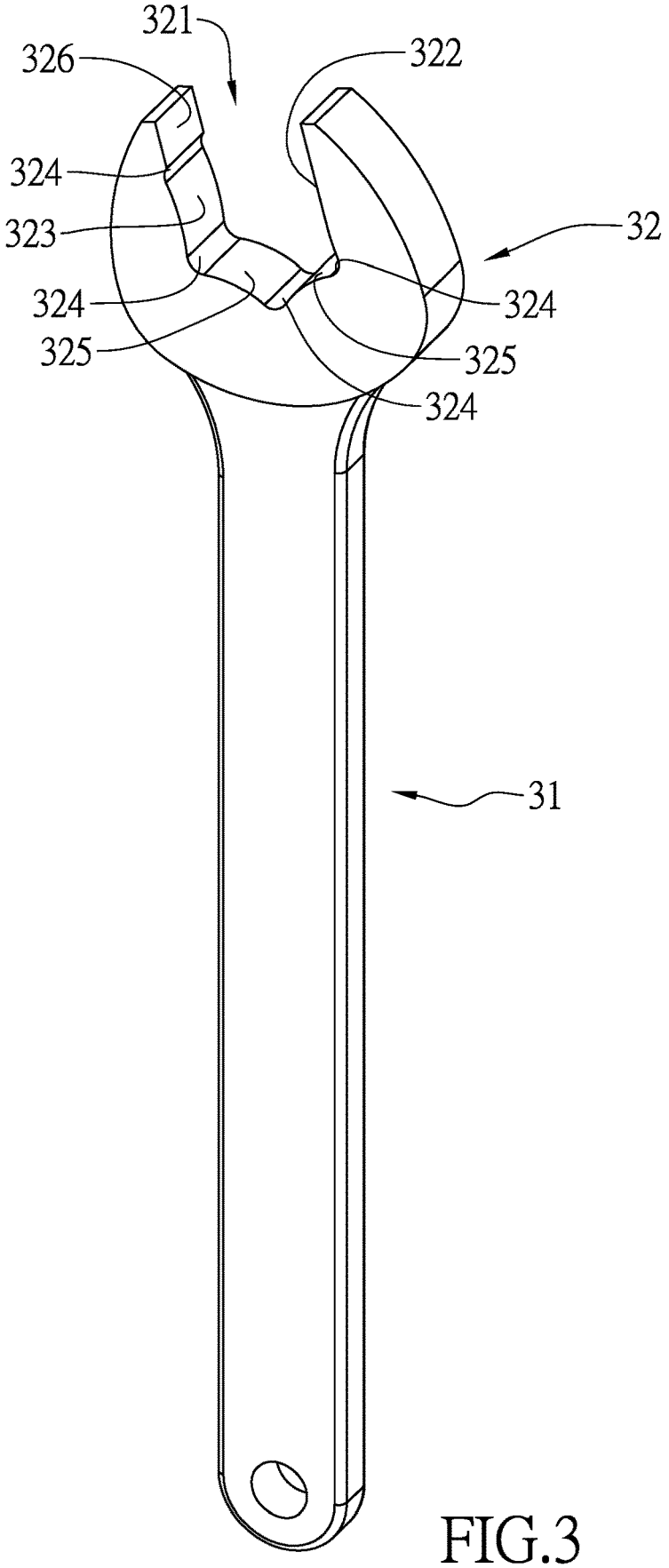
FIG. 3 is a perspective view of the present invention in a first embodiment.

The present invention will be clearer from the following description when viewed together with the accompanying drawings, which show, for purpose of illustrations only, the preferred embodiment in accordance with the present invention.

Referring to FIGS. 3-6, the present invention is an asymmetrical structure for an open-ended wrench, which essentially comprises a handle 31 and a working head 32 connected to each other, and the working head 32 is located at one end of the handle 31.

The working head 32 is provided with an opening 321 that is open, and a force-receiving surface 322, a force-applying surface 323, four round-angle surfaces 324 and two fixing surfaces 325, which face the opening 321. The force-receiving surface 322 is a flat surface facing the opening 321. The opening 321 is used for engaging with a nut. When the nut is located in the opening 321, the torque center of the nut defines an axial center P1 in the opening 321, and the axial center P1 extends toward the force-receiving surface 322 to define a horizontal axis X perpendicular to the force-receiving surface 322. The force-applying surface 323 is an arc surface protruding toward the axial center P1, and the axial center P1 extends along the horizontal axis X to the force-applying surface 323 to define a force-applying point 3231. A distance extending from the axial center P1 along the horizontal axis X to the force-receiving surface 322 is equal to a distance extending from the axial center P1 along the horizontal axis X to the force-applying point 3231. Two of the four round-angle surfaces 324 are respectively connected to two ends of the force-applying surface 323, so that the force-applying surface 323 is located between the two round-angle surfaces 324. The positions where the two round-angle surfaces 324 are connected to the force-applying surface 323 respectively define a tangent point P2, and a force-applying distance T is defined between the force-applying point 3231 and each of the tangent points P2 along the extension direction of the horizontal axis X. The two tangent points P2 are connected to the axial center P1 by two radial lines L1, a radial angle θ is sandwiched between the two radial lines L1, and the radial angle θ is 10 to 60 degrees. In a preferred embodiment, when the radial angle θ is between 20 degrees and 45 degrees, the arc surface of the force-applying surface 323 can be made more arc and convex, and the contact between the force-applying point 3231 and the nut can be better, so that the torque force can be transmitted better. In addition, the other two round-angle surfaces 324 and two fixing surfaces 325 in the opening 321 of the working head 32 are arranged in such a way that the force-receiving surface 322 and the two fixing surfaces 325 are respectively connected to the two round-angle surfaces 324, that is, there is a round-angle surface 324 between the force-receiving surface 322 and a fixing surface 325, and another round-angle surface 324 is connected between the two fixing surfaces 325, so that when the nut enters the opening 321 of the working head 32, the force-receiving surface 322, the fixing surfaces 325, the force-applying surface 323 and the respective round-angle surfaces 324 can work together to achieve an anti-slip function.

Figure 4:
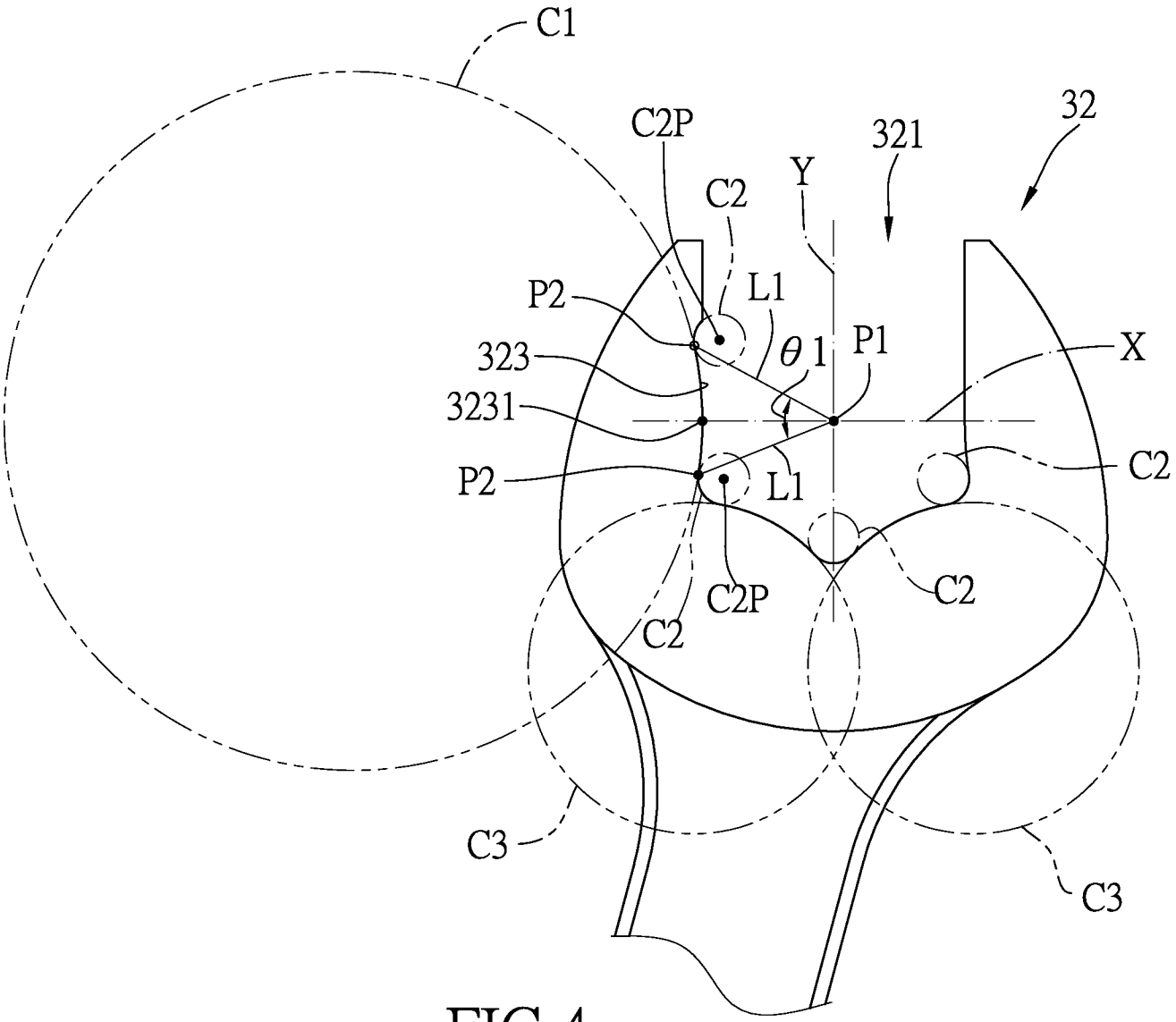
FIG. 4 shows a schematic diagram of the imaginary circles formed by the arcs of the working head.
Figure 5:
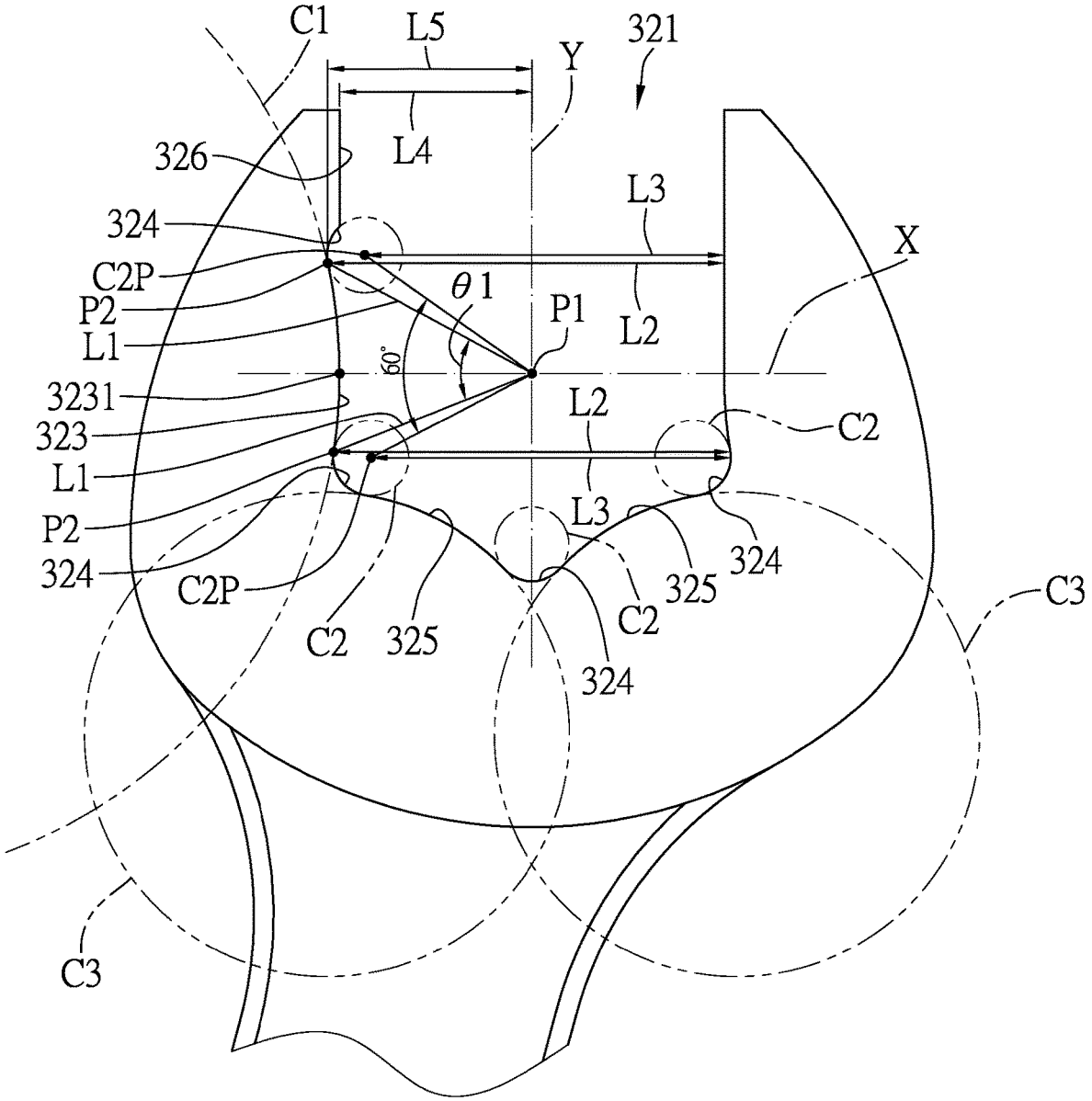
FIG. 5 is a magnified side view of a part of the working head.
Figure 6:
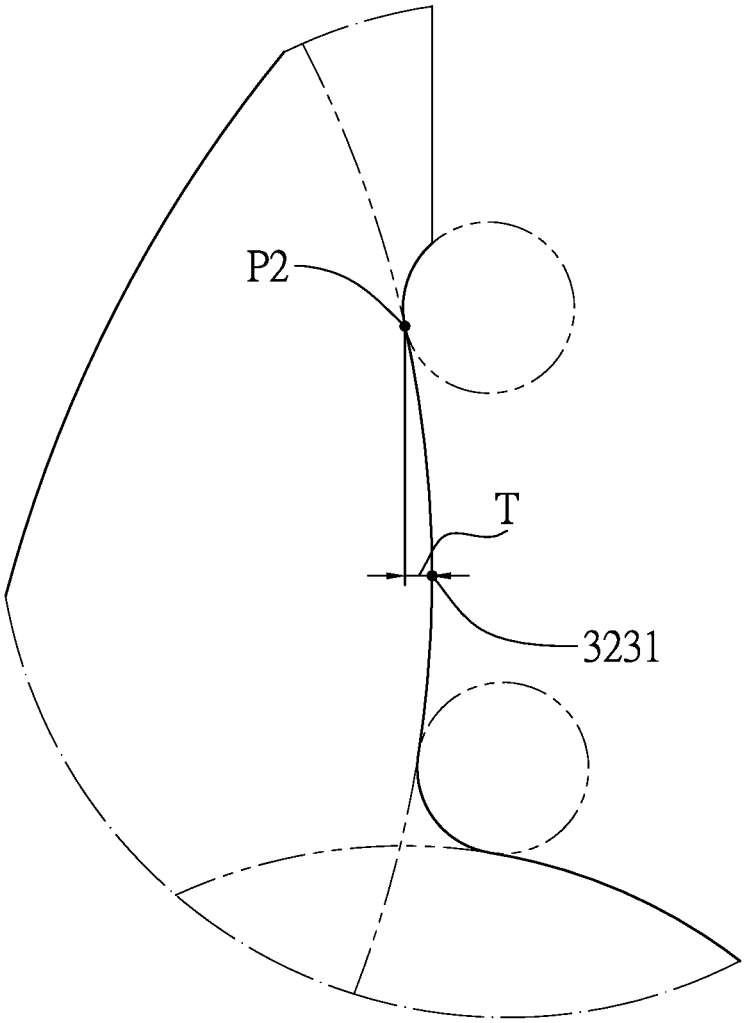
FIG. 6 is a magnified side view of a part of the force-applying surface.
Figure 7:
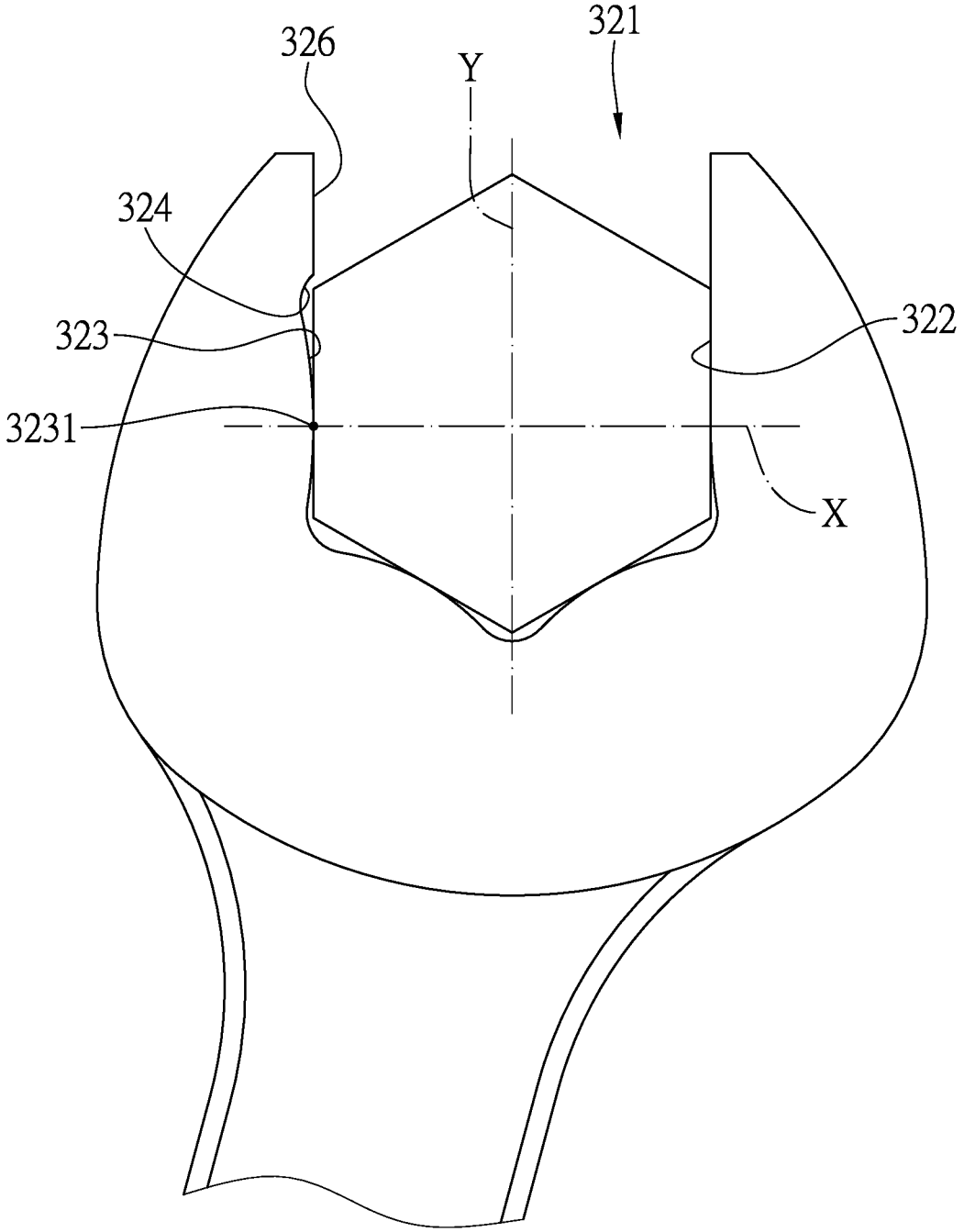
FIG. 7 is a schematic diagram of the use state of the nut engaged in the working head.

Please refer to FIGS. 4 and 5, the force-applying surface 323 is an arc of a first imaginary circle C1 with a diameter of 25.3 cm, and each of the round-angle surfaces 324 is an arc of a second imaginary circle C2 of 1.87 cm. In particular, the second imaginary circles C2 of the two round-angle surfaces 324 connected to the force-applying surface 323 each have a center C2P, the lines extending from the centers C2P of the two second imaginary circles C2 specified above to the axial center P1 define one of the split angles of the hexagonal nut. Therefore, the angle defined by the lines extending from the centers C2P of the two second imaginary circles C2 to the axial center P1 is 60 degrees.

Please refer to FIG. 5, each of the tangent points P2 defined at the positions where the force-applying surface 323 and the two round-angle surfaces 324 are connected is located at the position where the first imaginary circle C1 and the two second imaginary circles C2 are tangent to each other. The two tangent points P2 extend along the horizontal axis X to define two tangent lines L2, the centers C2P of the two second imaginary circles C2 extend along the horizontal axis X to define two axes L3, the tangent lines L2 are parallel to the axes L3, and the tangent lines L2 are located between the two axes L3, so that the split angle defined by the two tangent points P2 is slightly smaller than that of the hexagonal nut.

Furthermore, referring to FIG. 5, the opening 321 includes the round-angle surface 324, the force-applying surface 323, the round-angle surface 324, the fixing surface 325, the round-angle surface 324, the fixing surface 325, the round-angle surface 324 and the force-receiving surface 322, which are arranged in order. The center C2P of the second imaginary circle C2 defined by each round-angle surface 324 extends to the axial center P1, and an angle between two adjacent round-angle surfaces 324 is 60 degrees, which is exactly one of the split angles of a nut; and the two fixing surfaces 325 are respectively an arc of a third imaginary circle C3 with a diameter of 12 cm.

Please refer to FIG. 5, the working head 32 further includes a clamping surface 326 facing the opening 321, the clamping surface 326 is connected to one of the round-angle surfaces 324, so that this specified round-angle surface 324 is located between the clamping surface 326 and the force-applying surface 323. The axial center P1 extends to the center C2P of one of the round-angle surfaces 324 and defines a longitudinal axis Y perpendicular to the horizontal axis X, and the intersection point where the longitudinal axis Y and the horizontal axis X insect is exactly the axial center P1. There is a first distance L4 between the clamping surface 326 and the longitudinal axis Y along the horizontal axis X, a distance from the tangent point P2 of the round-angle surface 324 located between the clamping surface 326 and the force-applying surface 323 to the longitudinal axis Y along the horizontal axis X is a second distance L5, and the first distance L4 is smaller than the second distance L5. As can be understood from FIG. 5, since the clamping surface 326 is closer to the longitudinal axis Y in the extending direction of the horizontal axis X than the tangent point P2, when the nut is clamped in the opening 321 and the wrench is rotated, the specified round-angle surface 324 is able to prevent the nut from disengaging from the opening 321.

Figure 9:
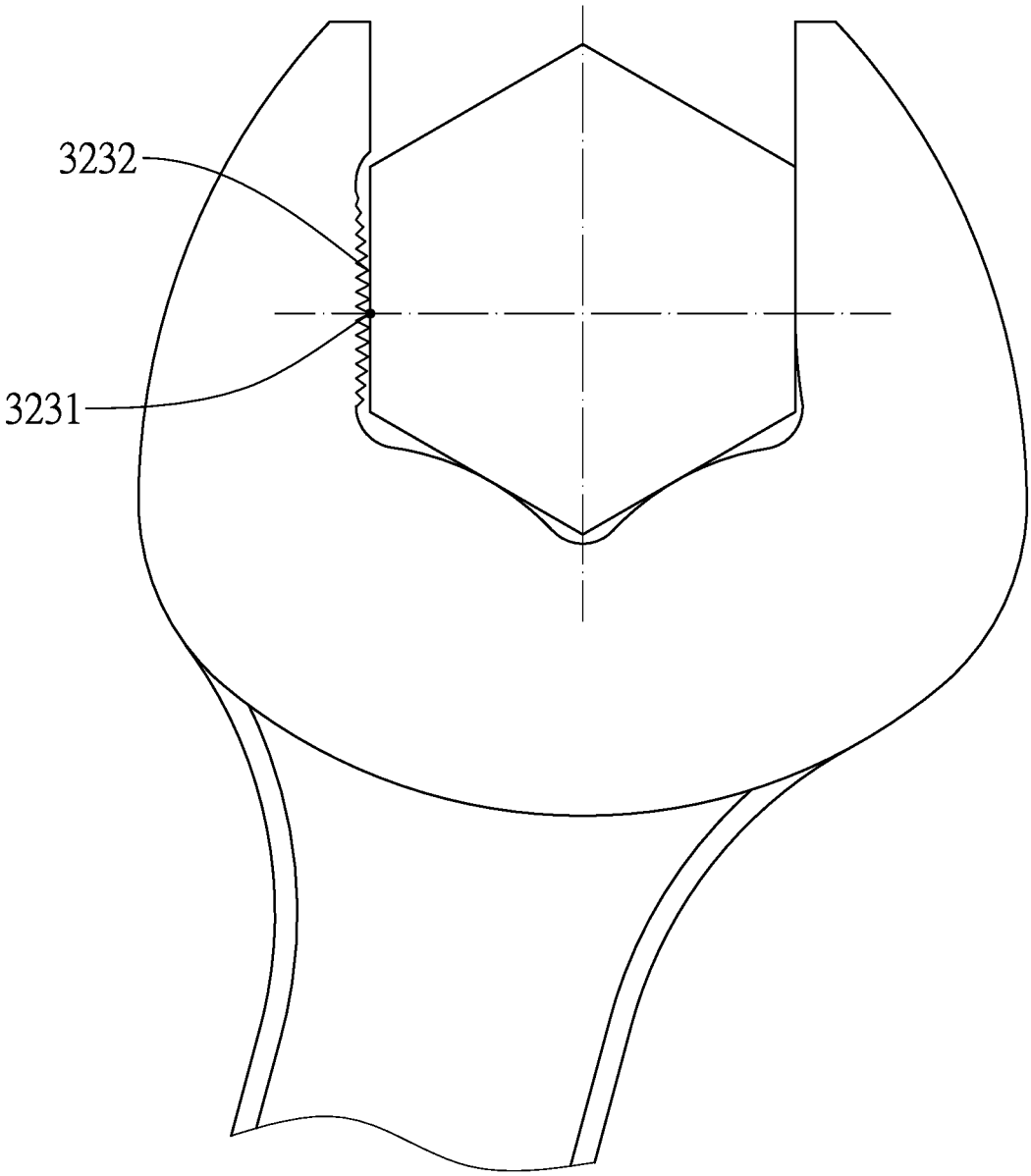
FIG. 9 is a magnified side view of a part of the present invention in a third embodiment.

Referring to FIG. 9, in a second embodiment, the force-applying surface 323 is provided with a plurality of teeth 3232, and the force-applying point 3231 is located at a position where the force-applying surface 323 intersects the horizontal axis X. By providing the teeth 3232 on the force-applying surface 323, when the nut rotates in the opening 321, the teeth 3232 can bite and fix the nut, thereby preventing the nut from slipping.

Figure 8:
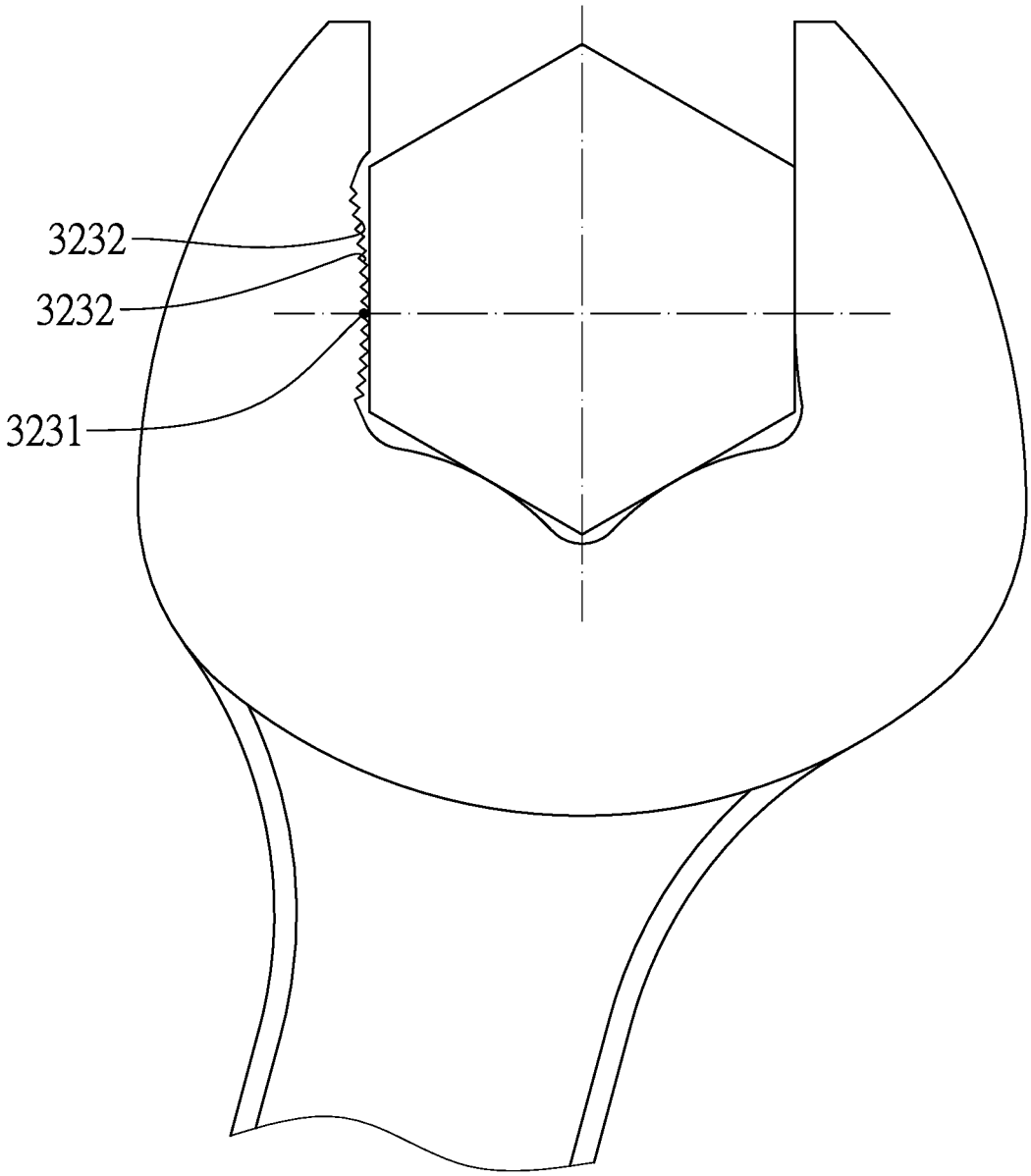
FIG. 8 is a magnified side view of a part of the present invention in a second embodiment.

Please refer to FIG. 8, in a third embodiment, the force-applying surface 323 is a flat surface and provided with a plurality of teeth 3232, the tips of the teeth 3232 sequentially form an arc surface of the force-applying surface 323, and the force-applying point 3231 is located at a position where the force-applying surface 323 intersects the horizontal axis X.

The above is the structural configuration and connection relationship of the present invention in a preferred embodiment, and the effects that the present invention can achieve are as follows:

Please refer to FIG. 9, when a nut is engaged in the opening 321, one of the two corresponding sides facing the nut abuts against the force-applying surface 323, and the other side abuts against the force-receiving surface 322. When the user turns the wrench, the force is applied to the nut from the force-applying surface 323 of the wrench. Since the force-applying surface 323 only has the force-applying point 3231 in contact with the nut, the force is only transmitted from the force-applying point 3231 to the nut, so that the force is concentrated on the force-applying point 3231 and applied to the nut, as a result, the force is further concentrated to make the nut easier rotate.

More preferably, when the nut is engaged in the opening 321, one of the sharp angles of the nut located correspondingly in the round-angle surface 324 between the clamping surface 326 and the force-applying surface 323. Since the clamping surface 326 is closer to the longitudinal axis Y in the extending direction of the horizontal axis X, when the nut is slightly deflected in the opening 321 and is about to come out, the sharp angle of the nut will be clamped between the clamping surface 326 and the round-angle surface 324 to prevent the nut from coining out of the opening 321.

In the present invention, by setting the force-applying surface 323 of the wrench as an arc surface, the force-applying surface 323 and the nut are contacted only by the force-applying point 3231, so that the force of the torque can be transmitted to the nut only through the force-applying point 3231, therefore the force is not dispersed and the user can turn the nut more easily.

More preferably, since the first distance L4 is smaller than the second distance L5, when the wrench is rotated and the nut slightly deflects in the opening 321, the sharp angle of the nut can be located correspondingly in one of the round-angle surfaces 324, so that the round-angle surface 324 can prevent the nut from coining out of the opening 321.

While we have shown and described various embodiments in accordance with the present invention, it is clear to those skilled in the art that further embodiments may be made without departing from the scope of the present invention.

What is claimed is:

1. An unsymmetrical structure for an open-ended wrench comprising:

a handle;

a working head disposed on the handle, wherein the working head is provided with an opening, and a force-receiving surface and a force-applying surface formed at two sides of the opening, the opening is used for engaging with a nut, the force-receiving surface is a flat surface facing the opening, a torque center of the nut defines an axial center in the opening, the axial center extends toward the force-receiving surface to define a horizontal axis perpendicular to the force-receiving surface, the force-applying surface protrudes toward the axial center, the axial center extends along the horizontal axis to the force-applying surface to define a force-applying point to cooperate with the force-receiving surface to clamp against two sides of the nut.

2. The unsymmetrical structure for the open-ended wrench as claimed in claim 1, wherein a round-angle surface and a fixing surface are defined in the opening of the working head, and the force-receiving surface is connected to the round-angle surface and the fixing surface.

3. The unsymmetrical structure for the open-ended wrench as claimed in claim 2, wherein another round-angle surface and another fixing surface are defined in the opening of the working head, so that the force-applying surface, one of the round-angle surfaces, one of the fixing surfaces, another of the round-angle surfaces, and another of the fixing surfaces are sequentially connected in the opening.

4. The unsymmetrical structure for the open-ended wrench as claimed in claim 2, wherein the force-applying surface is an arc of a first imaginary circle with a diameter of 25.3 cm, and each of the round-angle surfaces is an arc of a second imaginary circle of 1.87 cm.

5. The unsymmetrical structure for the open-ended wrench as claimed in claim 4, wherein each of the tangent points defined at the positions where the force-applying surface and the two round-angle surfaces are connected is located at the position where the first imaginary circle and the two second imaginary circles are tangent to each other, the two tangent points extend along the horizontal axis to define two tangent lines, the centers of the two second imaginary circles extend along the horizontal axis to define two axes, the tangent lines are parallel to the axes, and the tangent lines are located between the two axes.

6. The unsymmetrical structure for the open-ended wrench as claimed in claim 1, wherein the working head includes two round-angle surfaces facing the opening, the two round-angle surfaces are respectively connected to two ends of the force-applying surface, a tangent point is defined at each of the positions where the two round-angle surfaces are connected to the force-applying surface, and a force-applying distance is defined between the force-applying point and each of the tangent points along the horizontal axis.

7. The unsymmetrical structure for the open-ended wrench as claimed in claim 1, wherein the working head further includes a clamping surface facing the opening, the clamping surface is connected to one of the round-angle surfaces, so that this one of round-angle surfaces is located between the clamping surface and the force-applying surface, the axial center defines a longitudinal axis perpendicular to the horizontal axis, and an intersection point where the longitudinal axis and the horizontal axis insect is the axial center, there is a first distance between the clamping surface and the longitudinal axis along the horizontal axis, a distance from the tangent point of the round-angle surface located between the clamping surface and the force-applying surface to the longitudinal axis along the horizontal axis is a second distance, and the first distance is smaller than the second distance.

8. The unsymmetrical structure for the open-ended wrench as claimed in claim 7, wherein the force-applying surface is provided with a plurality of teeth, tips of the teeth sequentially form an arc surface of the force-applying surface, and the force-applying point is located at a position wherein the force-applying surface intersects the horizontal axis.

9. The unsymmetrical structure for the open-ended wrench as claimed in claim 1, wherein the force-applying surface is provided with a plurality of teeth, and the force-applying point is located at a position wherein the force-applying surface intersects the horizontal axis.

10. The unsymmetrical structure for the open-ended wrench as claimed in claim 9, wherein the radial angle is between 20 degrees and 45 degrees.

11. The unsymmetrical structure for the open-ended wrench as claimed in claim 1, wherein a distance extending from the axial center along the horizontal axis to the force-receiving surface is equal to a distance extending from the axial center along the horizontal axis to the force-applying point, the two tangent points are connected to the axial center by two radial lines, a radial angle is sandwiched between the two radial lines, and the radial angle is 10 to 60 degrees.

* * * * *